US009281565B2

(12) United States Patent
Chiu et al.

(10) Patent No.: US 9,281,565 B2
(45) Date of Patent: Mar. 8, 2016

(54) MULTI-FREQUENCY ANTENNA

(71) Applicant: ADVANCED-CONNECTEK INC., New Taipei (TW)

(72) Inventors: Tsung-Wen Chiu, New Taipei (TW); Fu-Ren Hsiao, New Taipei (TW); Yao-Yuan Chang, New Taipei (TW); Kuo-Chan Fu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 408 days.

(21) Appl. No.: 13/954,747

(22) Filed: Jul. 30, 2013

(65) Prior Publication Data

US 2013/0307733 A1 Nov. 21, 2013

Related U.S. Application Data

(63) Continuation-in-part of application No. 13/025,000, filed on Feb. 10, 2011, now abandoned.

(30) Foreign Application Priority Data

Sep. 17, 2010 (TW) ..... 99131559 A

(51) Int. Cl.

| | |
|---|---|
| ***H01Q 1/38*** | (2006.01) |
| ***H01Q 9/16*** | (2006.01) |
| ***H01Q 1/22*** | (2006.01) |
| ***H01Q 9/26*** | (2006.01) |
| ***H01Q 5/371*** | (2015.01) |

(52) U.S. Cl.

CPC ..... *H01Q 9/16* (2013.01); *H01Q 1/2266* (2013.01); *H01Q 5/371* (2015.01); *H01Q 9/26* (2013.01)

(58) Field of Classification Search

CPC ..... H01Q 9/26; H01Q 5/371
USPC ..... 343/700 MS, 702, 829, 846
See application file for complete search history.

(56) References Cited

U.S. PATENT DOCUMENTS

| | | | | |
|---|---|---|---|---|
| 6,812,892 | B2 * | 11/2004 | Tai | H01Q 1/243 343/700 MS |
| 6,861,986 | B2 * | 3/2005 | Fang | G06F 1/1616 343/700 MS |
| 7,136,025 | B2 * | 11/2006 | Lin | H01Q 9/0421 343/700 MS |
| 7,289,071 | B2 | 10/2007 | Hung et al. | |
| 7,292,194 | B2 * | 11/2007 | Tai | H01Q 9/0421 343/702 |
| 7,339,536 | B2 * | 3/2008 | Hung | H01Q 1/2266 343/700 MS |
| 7,362,277 | B2 * | 4/2008 | Su | H01Q 1/243 343/700 MS |
| 7,466,272 | B1 | 12/2008 | Su et al. | |
| 8,154,468 | B2 * | 4/2012 | Ke | H01Q 1/2266 343/846 |

* cited by examiner

*Primary Examiner* — Tho G Phan
(74) *Attorney, Agent, or Firm* — Tracy M. Heims; Apex Juris, Pllc

(57) ABSTRACT

A multi-frequency antenna includes a first antenna element, a second antenna element, a connection element, a third antenna element and a shorted element. The connection element is connected between the first antenna element and a neighborhood portion of the third antenna element. A feeding point is located in or nearby a first junction between the connection element and the first antenna element or located in the connection element. The shorted element is connected between the second antenna element and the grounding plane. The shorted element extends from a second junction between the second antenna element and the third antenna element to the grounding plane. The first conductive path that extends from the feeding point to the other end of the shorted element is substantially equal to a second conductive length that extends from the feeding point to the free end of the first antenna element.

20 Claims, 4 Drawing Sheets

MULTI-FREQUENCY ANTENNA

CROSS-REFERENCES TO RELATED APPLICATIONS

This non-provisional application claims priority under 35 U.S.C. §119(a) on patent application Ser. No. 13/025,000 filed in United States. on Feb. 10, 2011, the entire contents of which are hereby incorporated by reference.

BACKGROUND OF THE INVENTION

1. Field of the Invention

The present invention relates to an antenna, and more particularly to a multi-frequency antenna, which integrates several operating frequency bands therein.

2. Descriptions of the Related Art

With fast progress of wireless communication technology, RF channels become more and more crowded. Wireless communication technology has expanded from dual-band systems to triple-band or even quad-band systems. In 2007, the industry of notebook computer's antenna has a bigger change: The wireless communication begins to enter the 3G or 3.5G age after the Centrino chip had pushed maturation of built-in WLAN. Thus, the number of the built-in antennae also increases. The current notebook computers are mainly equipped with built-in antennae. In the Centrino age, there are only two built-in antennae. In the 3G age, there may be 5-6 built-in antennae. The additional antennae include an 802.11n MIMO antenna, two 3G antennae, and even one or two UWB antennae. Such dual-band antenna is for example disclosed in U.S. Pat. No. 7,466,272 B1. Usually, a multi-frequency antenna is integrally made by cutting and bending a metal sheet to form a three-dimensional structure. Further, in a quad-band antenna with two coaxial cables, one coaxial cable feeds signal to both a first and second antennas, and the other feeds signal to both a third and fourth antennas, such as the structure taught in U.S. Pat. No. 7,289,071 B2.

After notebook computers joined the mobile communication industry, the manufacturers have to propose a sophisticated antenna design and a superior RF system implementation tactic, in addition to a standard 3G communication module, so that the notebook computers can transceive signals accurately and noiselessly in a communication environment full of interference. Further, a notebook computer involves many communication systems, such as GPS, BT, Wi-Fi, WiMax, 3G/LTE and DIV. How to achieve an optimized design compatible to these wireless communication systems has been a critical technology in the field. The customers have a very high requirement for the compactness and slimness of notebook computers. How to integrate more and more antenna modules into smaller and smaller space without mutual interference becomes a big challenge for designers.

SUMMARY OF THE INVENTION

The multi-frequency antenna according to the present invention simultaneously has a antenna structure of a dual-band antenna and a antenna structure of a single-band antenna, and can prevent from mutual interference of the antennae structure. Moreover, the antenna structures have common elements, thereby miniaturizing the antenna system. Furthermore, such multi-frequency antenna structure can achieve a superior impedance matching by fine-tuning the length, size and volume of a shorted element, and the length, size and shape of antenna elements are also fine-tuned to make the system bandwidth of the antenna have superior impedance matching.

In one embodiment, the multi-frequency antenna comprises a first antenna element, a second antenna element, a connection element, a third antenna element and a shorted element. The first antenna element operates at a first frequency band, and one end of the first antenna element is a free end. The second antenna element operates at a second frequency band. The connection element is connected to the other end of the first antenna element. A coaxial cable has an inner connector and an outer conductor. The inner connector is connected to a feeding point, and the outer conductor is connected to a grounding plane. The feeding point is located in or nearby a first junction between the connection element and the first antenna element. The third antenna element operates at a third frequency band, and a neighborhood portion of the third antenna element is connected to the other end of the connection element. The shorted element is connected between the second antenna element and the grounding plane, and one end of the shorted element extends from a second junction between the second antenna element and the third antenna element. A first conductive path that extends from the feeding point to the other end of the shorted element is substantially equal to a second conductive length that extends from the feeding point to the free end of the first antenna element.

In another embodiment, the feeding point is located in the connection element.

Below, the embodiments are described in detail to further demonstrate the technical contents of the present invention.

DESCRIPTION OF THE PREFERRED EMBODIMENT

In the following description, this invention will be explained with reference to embodiments thereof. However, these embodiments are not intended to limit this invention to any specific environment, applications or particular implementations described in these embodiments. Therefore, description of these embodiments is only provided for purpose of illustration but not to limit this invention. It should be appreciated that, in the following embodiments and the attached drawings, elements not related directly to this invention are omitted from depiction.

Figure 1:
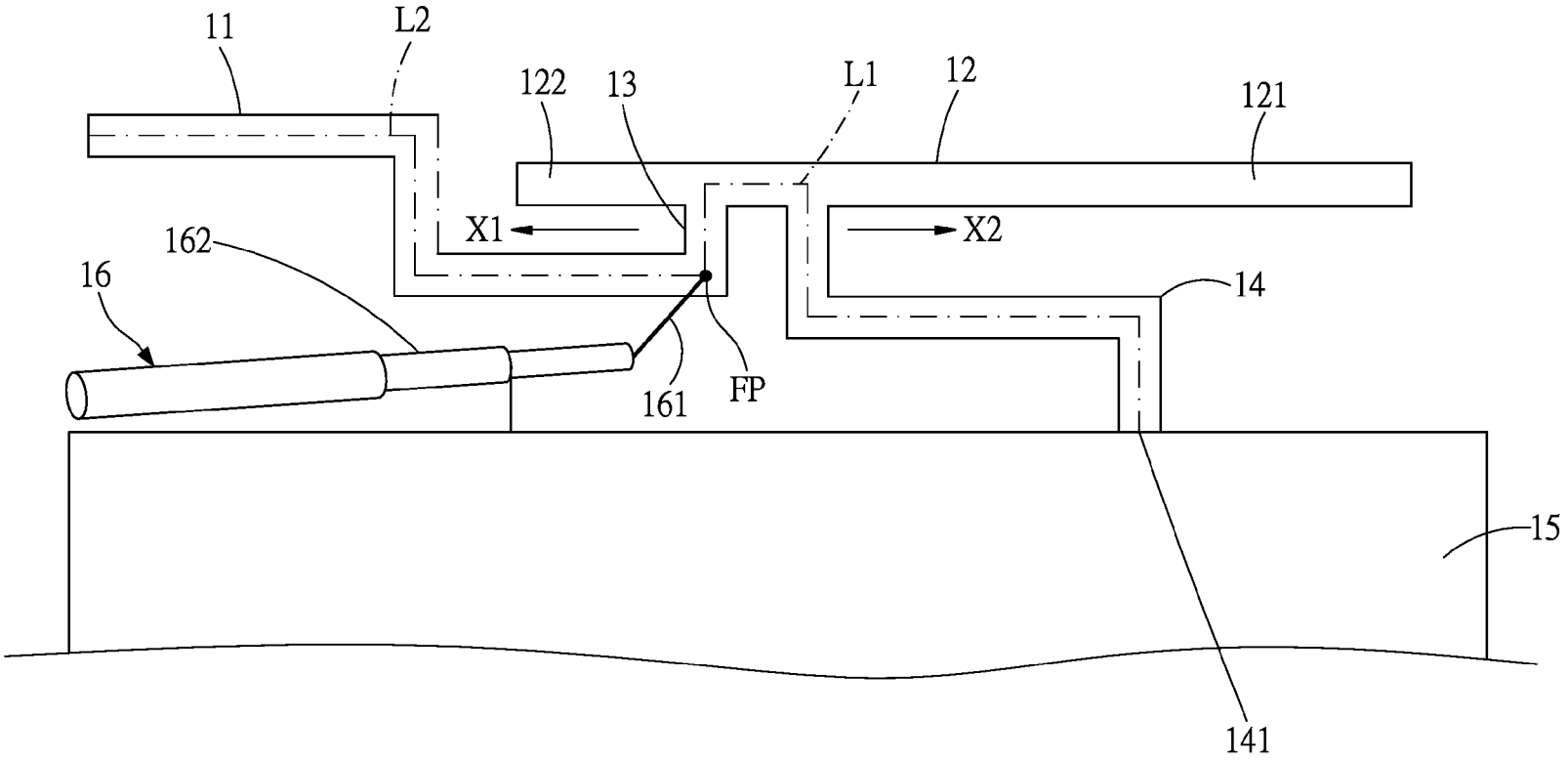
FIG. 1 is a top view of a multi-frequency antenna according to a first embodiment of the present invention.

Refer to FIG. 1, which is a top view of a multi-frequency antenna according to a first embodiment of the present invention. The multi-frequency antenna of the present invention comprises a first antenna element 11, a second antenna element 121, a third antenna element 122, a connection element 13, and a shorted element 14. The multi-frequency antenna is disposed on a substrate, which is, for example, a printed circuit board. That is, the first antenna element 11, the second antenna element 121, the third antenna element 122, the connection element 13, and the shorted element 14 are disposed on the substrate.

The first antenna element 11 defines two ends and has a serpentine shape but the embodiments of the present invention are not limited thereto. One end of the first antenna element 11 is a free end. The other end of the first antenna element 11 is connected to one end of the connection element 13. In other words, the connection element 13 is extended from and perpendicular to the other end of the first antenna element 11. The connection element 13 is formed as a first strip. A coaxial cable 16 has a core wire 161 or an inner conductor 161 connected to a feeding point FP and a shield 162 or an outer conductor 162, which is circular and surrounds the core wire 161 or the inner conductor 161, connected to a grounding plane 15. The position of the feeding point FP could be located on or nearby a first junction between the connection element 13 and the first antenna element 11. The position of the feeding point FP could be also located on any position of the connection element 13.

The second antenna element 121 is disposed along the opposite direction X2 relative to the lengthwise direction X1 of the first antenna element 11. In other words, the multi-frequency antenna has first side and second side opposite to each other. The free end of the first antenna element 11 extends toward the first side, and the free end of the second antenna element 121 extends toward the second side.

The third antenna element 122 is disposed on an upper region relative to the serpentine shape of the first antenna element 11. The third antenna element 122 is extended from the second antenna element 121 and along the lengthwise direction X1 of the first antenna element 11, such that the third antenna element 122 and the second antenna element 121 are formed as a second strip. In other words, the third antenna element 122 has one free end and one close end. The close end of the third antenna element 122 is connected to the second antenna element 121, and the free end of the third antenna element 122 extends toward the first side of the multi-frequency antenna. In some embodiments, the third antenna element 122 and the second antenna element 121 can be a straight strip.

And the other end of the connection element 13 is connected to a neighborhood portion of the third antenna element 122 but not connected to any end of the third antenna element 122. In other words, the neighborhood portion of the third antenna element 122 is not located in any end portion of the third antenna element 122. The second strip is perpendicular to the aforementioned first strip. Consequently, the connection element 13 is connected between the first antenna element 11 and the third antenna element 122. In this first embodiment, the first antenna element 11 and the third antenna element 122 are located on the left side of the connection element 13 and the second antenna element is located on the right side of the connection element 13. The first antenna element 11 and the third antenna element 122 lie in the transverse direction X1 and the second antenna element 121 lies in the transverse direction X2. The connection element 13 lies in a vertical direction which is perpendicular to the transverse directions X1 and X2. Hence the cross segments of the first antenna element 11 are parallel to the third antenna element 122 and the second antenna element 121. The first antenna element 11 has at least one vertical segment, each of which is parallel to the connection element 13.

The shorted element 14 is connected between the second antenna element 121 and the grounding plane 15. In this embodiment, one end of the shorted element 14 extends serpentinely from a second junction between the third antenna element 122 and the second antenna element 121 and the other end 141 of the shorted element 14 is connected to the grounding plane 15 but the embodiments of the present invention are not limited thereto. That is to say, the shorted element 14 has at least one cross segment, each of which is parallel to the second antenna element 121 and the shorted element 14 has at least one vertical segments, each of which is parallel to the connection element 13. The shorted element 14 is located on the right side of the connection element 13.

Figure 3:
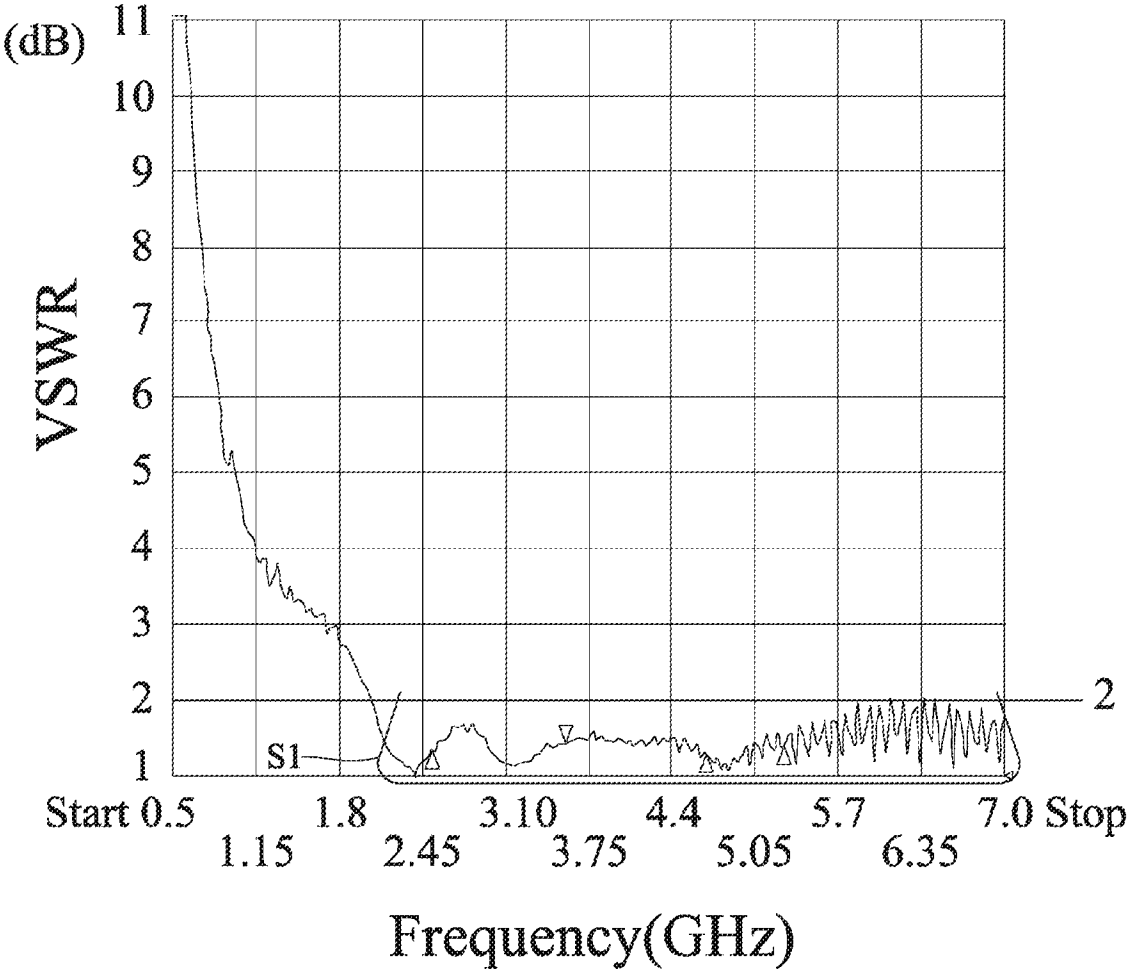
FIG. 3 is a diagram showing the VSWR measurement results of the multi-frequency antenna according to the second embodiment of the present invention.

In the first embodiment, the connection element 13, the second antenna element 121, the third antenna element 122, and the shorted element 14 form a dual-band antenna structure, as well as the first antenna element 11, the connection element 13, and the shorted element 14 form a single-band antenna structure. In the first embodiment, the first antenna element 11 allows communications in a first frequency band, namely, the 2.4 GHz band (which is a low-frequency frequency band with a central frequency of 2.4 GHz), the second antenna element 121 allows communications in a second frequency band, namely, the 3.1 GHz band (which is another low-frequency frequency band with a central frequency of 3.1 GHz), and the third antenna element 122 allows communications in a third frequency band, namely, the 5 GHz band (which is a high-frequency frequency band with a central frequency of 5 GHz), as shown in FIG. 3. Referring to FIG. 3, the central frequency of the first frequency band is nearby the central frequency of the second frequency band such that the first band is composed of the bandwidth of the first frequency band and that of the second frequency band and the second band is the bandwidth of the third frequency band. Please referring to FIG. 1, more specifically, for the dual-band antenna structure, the connection element 13, a part of the second antenna element 121, and the shorted member 14 are in the form of a first conductive path L1 that extends from the feeding point FP to the other end 141 of the shorted element 14. The first conductive path L1 is approximately a quarter of a wavelength corresponding to the central frequency of the first frequency band. That is, the distance between feeding point FP and the other end 141 of the shorted element 14 is substantially a quarter of a wavelength corresponding to the central frequency of the first frequency band.

In order to prevent from the interference between the first frequency band and the second frequency band which have similar central frequency, the first conductive path L1 that extends from the feeding point FP to the other end 141 of the shorted element 14 is substantially equal to a second conductive length L2 that extends from the feeding point FP to the free end of the first antenna element 11. That is, the distance between feeding point FP and the free end of the first antenna element 11 is substantially a quarter of a wavelength corresponding to the central frequency of the first frequency band. When the first conductive path L1 is equal to the second conductive length L2 and the first antenna element 11 is operating at the first central frequency of 2.4 GHz, the shorted element 14, the second antenna element 121, and the third antenna element 122 are nearly an open circuit. That is, the termination impedance "seen" from the feeding point FP of the shorted element 14, the second antenna element 121, and the third antenna element 122 presents and seems an infinite impedance at the first central frequency of 2.4 GHz.

In the first embodiment, the first antenna element 11 has a Z-like shape, which may be divided into three rectangle shapes. The first rectangle shape of the first antenna element 11 connected with the connection element 13 has a length of about 20 mm and a width of about 2 mm. The second rectangle shape of the first antenna element 11 has a length of about 6 mm and a width of about 2 mm. The third rectangle shape of the first antenna element 11 has a length of about 22 mm and a width of about 2 mm. The second antenna element 121 together with the third antenna element 122 is a rectangular shape with a length of 56 mm and a width of about 2 mm. The connection element 13 has a rectangular shape with a length of about 5 mm and a width of about 2 mm. The shorted element 14 has a Z-like shape, which may be divided into three rectangle shapes. The first rectangle shape of the shorted element 14 connected with the second antenna element 121 has a length of about 8 mm and a width of about 2 mm. The second rectangle shape of the shorted element 14 has a length of 22 mm and a width of about 2 mm. The third rectangle shape of the shorted element 14 connected with the grounding plane 15 has a length of about 9 mm and a width of about 2 mm.

In this embodiment, the first antenna element 11, the second antenna element 121, the third antenna element 122, the connection element 13, and the shorted element 14 are made of mental material or conductive material. The first antenna element 11, the second antenna element 121, the third antenna element 122, the connection element 13, and the shorted element 14 could be printed on a substrate, which is, for example, a printed circuit board.

Figure 2:
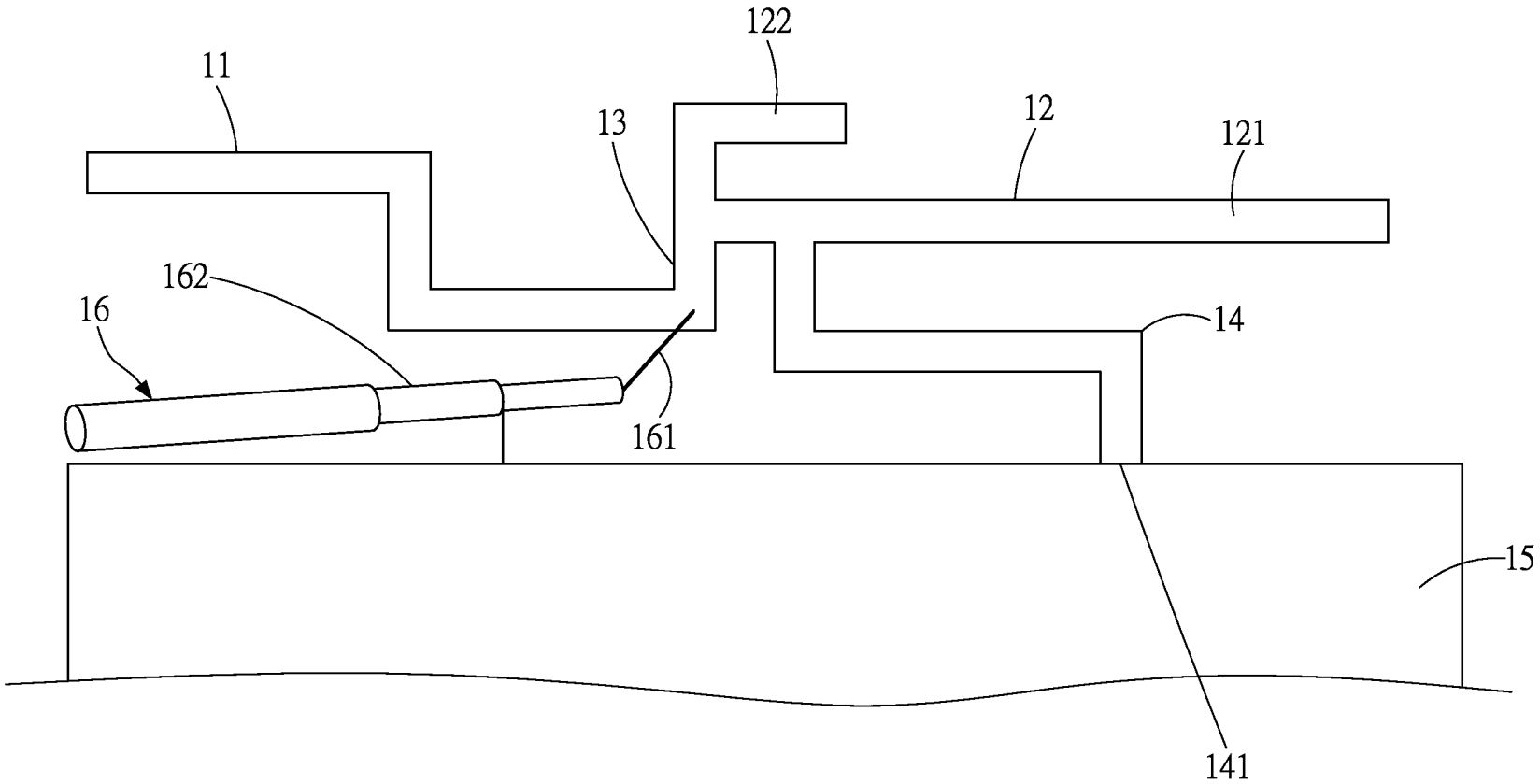
FIG. 2 is a top view of a multi-frequency antenna according to a second embodiment of the present invention.

Refer to FIG. 2, which is a top view of a multi-frequency antenna according to a second embodiment of the present invention. The second embodiment is basically similar to the first embodiment but different from the first embodiment. The part of the third antenna element 122 is a inverted-L shape, which extends from a third junction between the connection element 13 and the third antenna element 122, i.e. extends from the connection element 13 toward the second side where the second antenna element 121 is located, such that a concave space is formed between the third antenna element 122 and the second antenna element 121. Therefore, the antenna element design of the present invention not only can form diversified serpentine extensions of the antenna elements but also can increase the operating bandwidth and suitable frequency bands.

Refer to FIG. 3, which is a diagram showing the measurement results of the voltage standing wave ratio (VSWR) of the multi-frequency antenna according to the second embodiment of the present invention, wherein the horizontal axis represents frequency and the vertical axis represents dB. FIG. 3 shows that the operational frequency band S1 ranges from 2.0 to 7.0 GHz, which covers the frequency bands of the WLAN 802.11b/g system (ranging from 2.4 to 2.5 GHz), the WiMAX 2.3G system (ranging from 2.3 to 2.4 GHz), the WiMAX 2.5G (ranging from 2.5 to 2.7 GHz), the WiMAX 3.5G system (ranging from 3.3 to 3.8 GHz), and the WiMAX system (ranging from 4.9 to 2.825 GHz).

In the standards, an antenna is required to have VSWR lower than 3. Otherwise, the antenna would not have the required performance. FIG. 3 shows that VSWR is lower than 3 in all the frequency bands and lower than 2 in most of the frequency bands. Thus, the operating bandwidth is greatly increased. Therefore, FIG. 3 proves that the operating bandwidths of the present invention can satisfy the design requirement.

Figure 4:
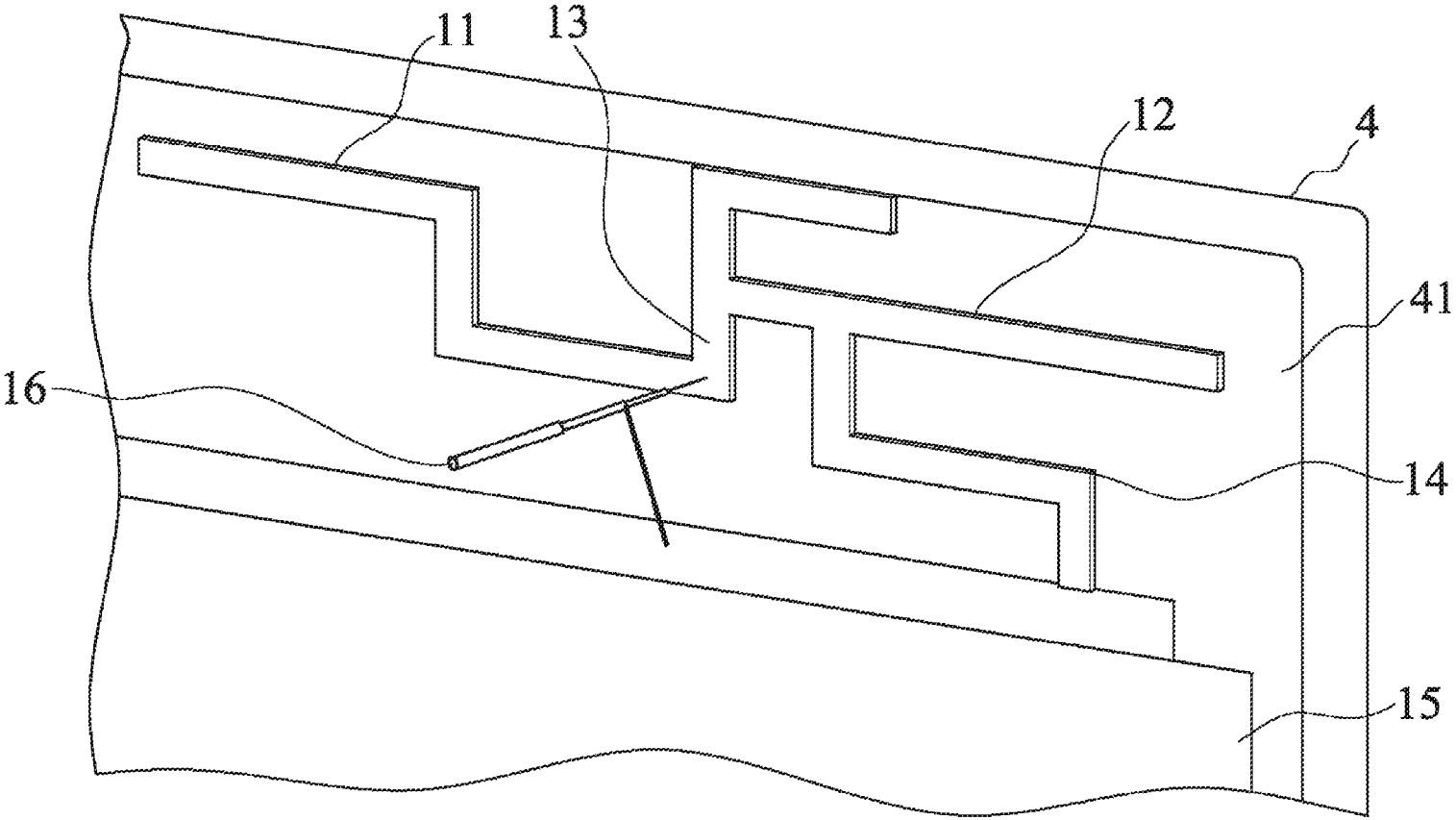
FIG. 4 is a partially-enlarged perspective view schematically showing that the multi-frequency antenna of the second embodiment of the present invention is applied to a portable computer.

Refer to FIG. 4, which is a partially-enlarged perspective view schematically showing that the multi-frequency antenna of the second embodiment is applied to a portable computer. The antenna module of the present invention is fixed to the display frame of a portable computer 4 to transceive wireless signals. In the present invention, the diversified serpentine extensions of antenna elements not only reduce the antenna volume but also favor the arrangement of the components.

The present invention possesses utility, novelty and non-obviousness and meets the condition for a patent. Thus, the Inventors file the application. It is appreciated if the patent is approved fast.

The embodiments described above are only to exemplify the present invention but not to limit the scope of the present invention. Any equivalent modification or variation according to the spirit of the present invention is to be also included within the scope of the present invention.

What is claimed is:

1. A multi-frequency antenna comprising:

a first antenna element for operating at a first frequency band and defining two ends, wherein one end of said first antenna element is a free end;

a connection element, one end of said connection element connected to the other end of said first antenna element, wherein a coaxial cable has an inner connector connected to a feeding point and an outer conductor connected to a grounding plane, wherein said feeding point is located in or nearby a first junction between said connection element and said first antenna element;

a second antenna element for operating at a second frequency band;

a third antenna element for operating at a third frequency band, wherein the other end of said connection element is connected to a neighborhood portion of said third antenna element; and a shorted element connected between said second antenna element and said grounding plane, wherein one end of said shorted element extends from a second junction between said second antenna element and said third antenna element and a first conductive path that extends from said feeding point to the other end of said shorted element is substantially equal to a second conductive length that extends from said feeding point to said free end of said first antenna element.

2. The multi-frequency antenna as claimed in claim 1, wherein the first antenna element has a serpentine shape.

3. The multi-frequency antenna as claimed in claim 1, wherein a distance between said feeding point and said free end of said first antenna element is substantially a quarter of a wavelength corresponding to a central frequency of said first frequency band.

4. The multi-frequency antenna as claimed in claim 1, wherein a part of the third antenna element is a inverted-L shape extending from said connection element toward a side where said second antenna element is located, such that a concave space is formed between said third antenna element and said second antenna element.

5. The multi-frequency antenna as claimed in claim 1, wherein said connection element is formed as a first strip, and said third antenna element and said second antenna element are formed as a second strip.

6. The multi-frequency antenna as claimed in claim 1, wherein said shorted element has at least one cross segment parallel to said second antenna element and at least one vertical segments parallel to said connection element.

7. The multi-frequency antenna as claimed in claim 1, wherein said first antenna element and said third antenna element are located in left side of said connection element, and said second antenna element is located in right side of said connection element.

8. The multi-frequency antenna as claimed in claim 1, wherein said first antenna element and said third antenna element lie in a transverse direction and said second antenna element lies in an opposite direction relative to said transverse direction.

9. The multi-frequency antenna as claimed in claim 8, wherein said connection element lies in a vertical direction perpendicular to said transverse direction.

10. The multi-frequency antenna as claimed in claim 1, wherein the central frequency of said first frequency band is nearby the central frequency of said second frequency band such that a first band is composed of the bandwidth of said first frequency band and that of said second frequency band, and said second band is the bandwidth of said third frequency band.

11. A multi-frequency antenna comprising:

a first antenna element for operating at a first frequency band and defining two ends, wherein one end of said first antenna element is a free end;

a connection element connected to the other end of said first antenna element, wherein a coaxial cable has an inner connector connected to a feeding point and an outer conductor connected to a grounding plane, wherein said feeding point is located in said connection element;

a second antenna element for operating at a second frequency band;

a third antenna element for operating at a third frequency band, wherein the other end of said connection element is connected to a neighborhood portion of said third antenna element; and a shorted element connected between said second antenna element and said grounding plane, wherein one end of said shorted element extends from a second junction between said second antenna element and said third antenna element and a first conductive path that extends from said feeding point to the other end of said shorted element is substantially equal to a second conductive length that extends from said feeding point to said free end of said first antenna element.

12. The multi-frequency antenna as claimed in claim 11, wherein the first antenna element has a serpentine shape.

13. The multi-frequency antenna as claimed in claim 11, wherein a distance between said feeding point and said free end of said first antenna element is substantially a quarter of a wavelength corresponding to a central frequency of said first frequency band.

14. The multi-frequency antenna as claimed in claim 11, wherein a part of the third antenna element is a inverted-L shape extending from said connection element toward a side where said second antenna element is located, such that a concave space is formed between said third antenna element and said second antenna element.

15. The multi-frequency antenna as claimed in claim 11, wherein said connection element is formed as a first strip, and said third antenna element and said second antenna element are formed as a second strip.

16. The multi-frequency antenna as claimed in claim 11, wherein said shorted element has at least one cross segment parallel to said second antenna element and said shorted element has at least one vertical segments parallel to said connection element.

17. The multi-frequency antenna as claimed in claim 11, wherein said first antenna element and said third antenna element are located in the left side of said connection element, and said second antenna element is located in the right side of said connection element.

18. The multi-frequency antenna as claimed in claim 11, wherein said first antenna element and said third antenna element lie in a transverse direction and said second antenna element lies in an opposite direction relative to said transverse direction.

19. The multi-frequency antenna as claimed in claim 18, wherein said connection element lies in a vertical direction perpendicular to said transverse direction.

20. The multi-frequency antenna as claimed in claim 11, wherein the central frequency of said first frequency band is nearby the central frequency of said second frequency band such that a first band is composed of the bandwidth of said first frequency band and that of said second frequency band, and said second band is the bandwidth of said third frequency band.

* * * * *